US006682611B2

(12) United States Patent
Zhang et al.

(10) Patent No.: US 6,682,611 B2
(45) Date of Patent: Jan. 27, 2004

(54) FORMATION OF ZR-BASED BULK METALLIC GLASSES FROM LOW PURITY MATERIALS BY YTTRIUM ADDITION

(75) Inventors: Yong Zhang, Beijing (CN); Ming Xiang Pan, Beijing (CN); De Qian Zhao, Beijing (CN); Wei Ilua Wang, Beijing (CN)

(73) Assignee: Liquid Metal Technologies, Inc., Lake Forest, CA (US)

( * ) Notice: Subject to any disclaimer, the term of this patent is extended or adjusted under 35 U.S.C. 154(b) by 70 days.

(21) Appl. No.: 10/020,386

(22) Filed: Oct. 30, 2001

(65) Prior Publication Data

US 2003/0079813 A1 May 1, 2003

(51) Int. Cl.[7] ..... C22C 45/10

(52) U.S. Cl. ..... 148/561; 148/403; 420/422; 420/423; 164/474

(58) Field of Search ..... 148/403, 421, 148/561, 538; 420/422, 423; 164/61, 474

(56) References Cited

U.S. PATENT DOCUMENTS

| | | | | |
|---|---|---|---|---|
| 5,032,196 | A | 7/1991 | Masumoto et al. | |
| 5,053,084 | A | * 10/1991 | Masumoto et al. | 148/403 |
| 5,368,659 | A | 11/1994 | Peker et al. | |
| 5,735,975 | A | 4/1998 | Lin et al. | |
| 5,797,443 | A | * 8/1998 | Lin et al. | 148/403 |
| 6,325,868 | B1 | * 12/2001 | Kim et al. | 148/403 |
| 2003/0034099 | A1 | 2/2003 | Liu | |

OTHER PUBLICATIONS

Altounian, et al., The Influence of Oxygen and Other Impurities on the Crystallization of $NiZr_2$ and Related Metallic Glasses, J. Appl. Phys., Jan. 1, 1997, pp. 149–155, vol. 61, No. 1, American Institute of Physics.

Conner, et al., Mechanical Properties of Tungsten and Steel Fiber Reinforced $Zr_{41.25}Ti_{13.75}Cu_{12.5}Ni_{10}Be_{22.5}$ Metallic Glass Matrix Composites, Acta Mater, 1998, pp. 6089–6102, vol. 46, No. 17, Elsevier Science Ltd., Great Britain.

Eckert, et al., Crystallization Behavior and Phase Formation in Zr–Al–Cu–Ni Metallic Glass Containing Oxygen, Materials Transactions, JIM, 1998, pp. 623–632, vol. 39, No. 6.

Gerbert, et al., Effect of Oxygen on Phase Formation and Thermal Stability of Slowly Cooled $Zr_{65}Al_{7.5}Cu_{17.5}Ni_{10}$ Metallic Glass, Acta Mater, 1998, pp. 5475–5482, vol. 46, No. 15, Elsevier Science Ltd., Great Britain.

Inoue, et al., Ferrous and Nonferrous Bulk Amorphous Alloys, Materials Science Forum, 1998, pp. 855–864, vols. 269–272, Trans Tech Publications, Switzerland.

Inoue, et al., Mg–Cu–Y Bulk Amorphous Alloys with High Tensile Strength Produced by a High–Pressure Die Casting Method, Materials Transactions, JIM, 1992, pp. 937–945, vol. 33, No. 10.

Inoue, et al., Zr–Y Base Amorphous Alloys with Two Glass Transitions and Two Supercooled Liquid Regions, Materials Science and Engineering, 1994, pp. 346–350, vols. A179/A180, Elsevier Sequoia.

Kim, et al., Ultrahigh Mechanical Strengths of $Al_{88}Y_2Ni_{10-x}M_x$ (M=Mn, Fe or Co) Amorphous Alloys Containing Nanoscale fcc–Al Particles, Materials Transactions, JIM, 1991, pp. 599–608, vol. 32, No. 7.

(List continued on next page.)

*Primary Examiner*—George Wyszomierski
(74) *Attorney, Agent, or Firm*—Christie, Parker & Hale, LLP

(57) ABSTRACT

A Zr-based bulk metallic glass formed using low purity materials at a low vacuum with a small amount of yttrium addition is provided. A method of improving the glass forming ability, crystallization and melting process without reducing the mechanical and elastic properties, such as hardness and Young's Modulus, of Zr-based alloys by yttrium addition, is also provided.

18 Claims, 5 Drawing Sheets

OTHER PUBLICATIONS

Kubaschewski, et al., Materials Thermochemistry, 1993, pp. 321–323, Pergamon Press, $6^{th}$ Edition.

Lin, et al., Effect of Oxygen Impurity on Crystallization of an Undercooled Bulk Glass Forming Zr–Ti–Cu–Ni–Al Alloy, Materials Transactions, JIM, 1997, pp. 473–477, vol. 38, No. 5.

Louzguine, et al., Influence of Rare Earth Metals (RE) on Formation Range and Structure of Amorphous Phase in Ge–Al–Cr–RE System, Materials Transactions, JIM, 1999, pp. 485–490, vol. 40, No. 6.

Peker, et al., A Highly Processable Metallic Glass: $Zr_{41.2}Ti_{13.8}Cu_{12.5}Ni_{10.0}Be_{22.5}$, Appl. Phys. Lett., Oct. 25, 1993, pp. 2342–2344, vol. 63, No. 17, American Institute of Physics.

Richter, et al., The Crystallization Characteristics of Y–Al Metallic Glasses, Journal of Materials Science Letters, 1985, pp. 1005–1009, vol. 4, Chapman and Hall Ltd.

Wang, et al., Enhanced Thermal Stability and Microhardness in Zr–Ti–Cu–Ni–Be bulk Amorphous Alloy by Carbon Addition, Applied Physics Letters, Jul. 7, 1997, pp. 58–60, vol. 71, No. 1, American Institute of Physics.

Wang, et al., Elastic Constants and Their Pressure Dependence of $Zr_{41}Ti_{14}Cu_{12.5}Ni_gBe_{22.5}C_1$ Bulk Metallic Glass, Applied Physics Letters, Mar. 29, 1999, pp. 1803–1805, vol. 74, No. 13, American Institute of Physics.

Wang, et al., Role of Small Atoms in the Formation and Properties of Zr–Ti–Cu–Ni–Be Bulk Amorphous Alloys, Journal of Applied Physics, Dec. 1, 1998, pp. 5961–5968, vol. 84, No. 11, American institute of Physics.

Zhang, et al. "Formation of Zr–Based Bulk Metallic Glasses from Low Purity of Materials by Yttrium Addition" Materials Transactions, JIM, 2000, pp. 1410–1414, vol. 41. No. 11, The Japan Institute of Metals.

Zhong, et al., Al–Ni–Y Nanophase Composites by Direct Quenching, International Journal of Non–Equilibrium Processing, 1998, pp. 35–53, vol. 11, Academic Publishers.

* cited by examiner

FORMATION OF ZR-BASED BULK METALLIC GLASSES FROM LOW PURITY MATERIALS BY YTTRIUM ADDITION

FIELD OF THE INVENTION

The present invention is directed to improved Zr-based bulk metallic glasses and more particularly to Zr-based bulk metallic glasses (BMG) prepared with low purity of zirconium under a low vacuum by introducing a small amount of yttrium into the alloy mix.

BACKGROUND OF INVENTION

Recently, many bulk metallic glass forming alloys, such as ZrAlNiCu and ZrTiCuNiBe have been developed. The new types of metallic glasses with excellent glass forming ability (GFA) promise to allow the production of large-scale bulk material by conventional casting processes at a low cooling rate. However, high vacuum (at least $10^{-3}$ Pa), high purity of constituent elements (the purity of zirconium is at least 99.99 at %, oxygen content should be less than 250 ppm) and high purity of argon gas are necessary for fabrication of the Zr-based bulk metallic glasses (BMGs), even traces of oxygen impurities and other impurities, e.g., carbon, induce the heterogeneous nucleation and reduce the GFA drastically. The strict processing makes the cost of Zr-based BMGs high, and limits its wide application.

Accordingly, an inexpensive reliable method is needed which makes it possible to form Zr-based bulk metallic glasses utilizing low purity Zr and low vacuum.

SUMMARY OF INVENTION

The present invention is directed to a Zr-based BMG having a small concentration of Y added thereto which can be prepared with a low purity of zirconium under a low. More particularly, the present invention is directed to Zr—Al—Ni—Cu and Zr—Ti—Ni—Cu—Be alloys containing a Y additive.

In one embodiment of the invention 2–4 at % yttrium is added to the Zr-based alloy composition.

BRIEF DESCRIPTION OF THE INVENTION

These and other features and advantages of the present invention will be better understood by reference to the following detailed description when considered in conjunction with the accompanying drawings wherein.

DETAILED DESCRIPTION OF THE INVENTION

The present invention is directed to a Zr-based BMG having a small concentration of Y added thereto which can be prepared with a low purity of zirconium under a low. More particularly, the present invention is directed to Zr—Al—Ni—Cu and Zr—Ti—Ni—Cu—Be alloys containing a Y additive.

Zr-based alloys alloys with a Y-additive may be prepared in any conventional fashion. In one exemplary embodiment, ingots of Zr-based alloys having the composition of $(Zr_{55}Al_{15}Ni_{10}Cu_{20})_{100-x}Y_x$(x=0–10), $(Zr_{65}Al_{7.5}Ni_{10}Cu_{17.5})_{100-x}Y_x$ (x=0–6), $(Zr_{41}Ti_{14}Cu_{12.5}Ni_{10}Be_{22.5})_{98}Y_2$, and $Zr_{34}Ti_{15}Cu_{12}Ni_{11}Be_{28}Y_2$ may be prepared by arc-melting elemental metals in a Ti-gettered argon atmosphere. In such an embodiment, the ingots may be inductively melted in a quartz tube at a low vacuum (1 Pa), and then cast into a water cooled copper mould having suitable shape and size. Although the alloys were cast into ingots in the above embodiment, it should be understood that any suitable casting technique and any suitable cast may be utilized with the current invention. In addition, although a number of different Zr-based alloys are described above, in one preferred embodiment, the Zr-based alloy has a composition comprising $Zr_{55}Al_{15}Ni_{10}Cu_{20}$.

Although any suitable purity of the zirconium may be utilized, in one embodiment the purity of the Zr is about 99.8 at %, including 1500 ppm of oxygen and other impurities. In such an embodiment, the purity of the other constituent elements is preferably about 99.9 at %.

As described above, any suitable content of Y additive may be used in the present invention. However, in one preferred embodiment the Y content is from about 0.01 to about 10 at %, and more preferably from about 2 to about 4 at %.

The structure and properties of the alloy created according to the above process may be identified by any suitable means. In one embodiment, a Siemens D5000 X-ray diffractometry with Cu $K_\alpha$ radiation may be utilized to determine the structure of the alloy. Similarly, the thermal properties may be measured by any suitable means, such as, for example, by a Perkin Elmer differential scanning calorimetry (DSC-7) and differential temperature analyzer (DTA-7). The density may be measured by the Archimedes method. The Vickers hardness (Hv) may be measured by microhardness-71 with a load of 200 g. Elastic constants may be determined by the ultrasonic method. The acoustic velocities may be measured using a pulse echo overlap method. And, the travel time of the ultrasonic waves propagating through the sample with a 10 MHz carrying frequency may be measured using a MATEC 6600 ultrasonic system with a measuring sensitive of 0.5 ns.

Utilizing the above analysis techniques a series of Zr-based alloys created according to the disclosed method were tested with and without the addition of Y.

Figure 1:
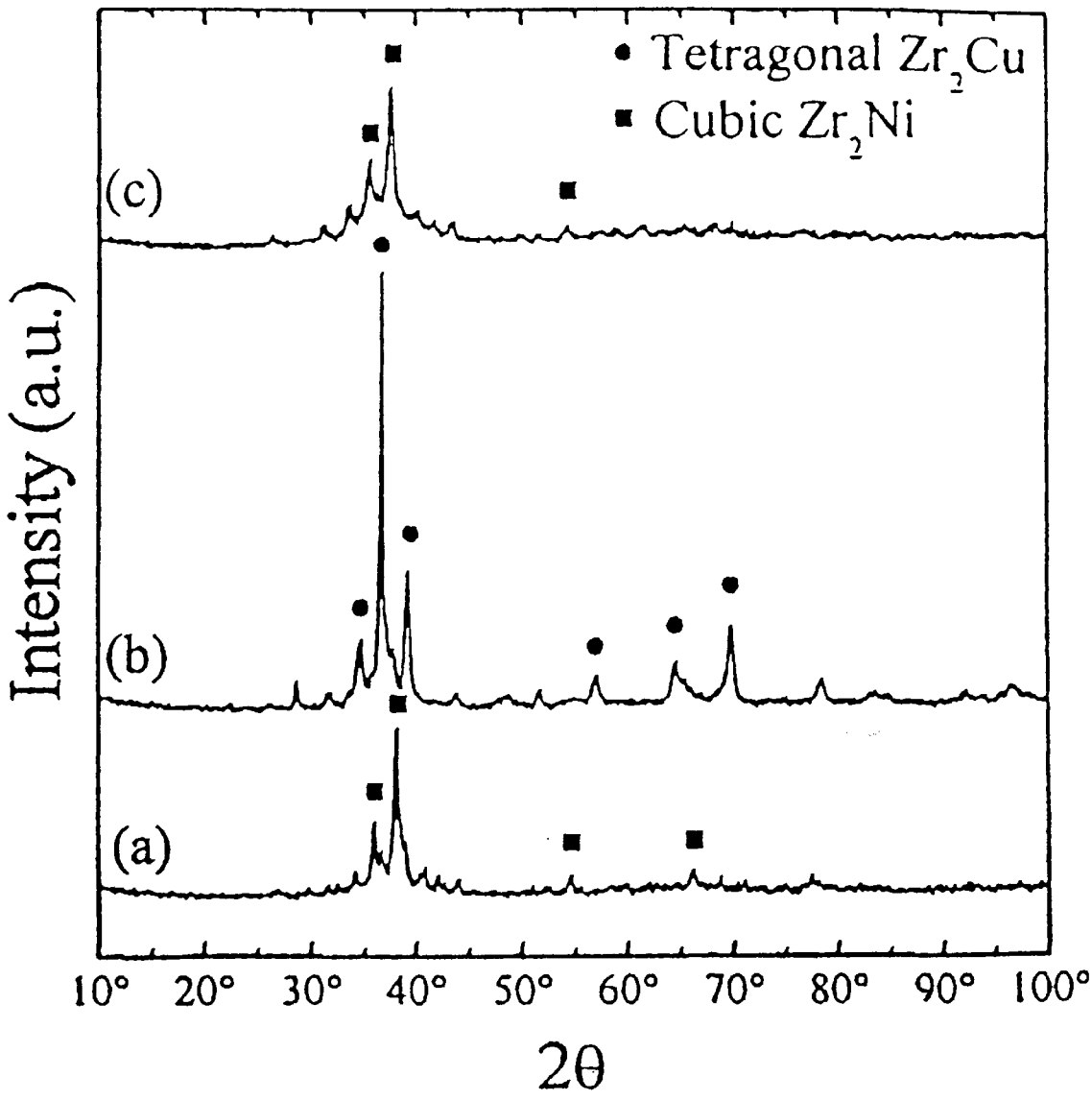
FIG. 1, shows XRD patterns of the $Zr_{55}Al_{15}Ni_{10}Cu_{20}$ alloy (a), and $Zr_{65}Al_{7.5}Ni_{10}Cu_{17.5}$ alloy (b) prepared by using low purity of Zr at low vacuum, and $Zr_{55}Al_{15}Ni_{10}Cu_{20}$ alloy (c) by using higher purity of Zr at a low vacuum.

FIG. 1 displays X-ray diffraction (XRD) patterns of the $Zr_{55}Al_{15}Ni_{10}Cu_{20}$ [curve (a) and curve (c)] and the $Zr_{65}Al_{7.5}Ni_{10}Cu_{17.5}$ [curve (b)] alloys. The alloys of the $Zr_{55}Al_{15}Ni_{10}Cu_{20}$ [FIG. 1(*a*)] and the $Zr_{65}Al_{7.5}Ni_{10}Cu_{17.5}$ [FIG. 1(*b*)] are prepared by using low purity of zirconium and at a low vacuum, FIG. 1(*c*) shows XRD of the $Zr_{55}Al_{15}Ni_{10}Cu_{20}$ alloy prepared by using higher purity of zirconium (99.99 at %) and at the same vacuum condition.

The figure shows that crystalline compound precipitates in all of the alloys during the cooling process, and almost no amorphous phase is formed in this processing condition for the alloys prepared by using low purity of Zirconium. However, the $Zr_{55}Al_{15}Ni_{10}Cu_{20}$ alloy using higher purity of Zirconium shows a diffused peak superimposed by some crystalline peaks, indicating the alloy contains more amorphous phase. Previous research has shown that the fully ZrAlNiCu BMGs can only be obtained at a high vacuum (at least $10^{-3}$ Pa), high purity and low oxygen content of constituent elements (the purity of Zr is at least 99.99 at %, oxygen content should be less than 250 ppm).

This result confirms that the purity and particularly the oxygen content of the element has a significant effect on the GFA of the alloy. Cubic $Zr_2Ni$ ($Al_2Cu$ type, space group Fd 3 m) is the main precipitation crystalline phase in the $Zr_{55}Al_{15}Ni_{10}Cu_{20}$ alloy. Previous research also found that oxygen can greatly enhance and stabilize the formation of cubic $Zr_2Ni$ phase in binary Zr—Ni alloy. The main precipitation phase is tetragonal $Zr_2Cu$ ($MoSi_2$ type, space group of I4/mmm) in the $Zr_{65}Al_{7.5}Ni_{10}Cu_{17.5}$ alloy as shown in FIG. 1. Other research has found that oxygen induced cubic phases (such as $Zr_2Ni$.) transformed into stable $Zr_2Cu$ compound in the $Zr_{65}Al_{7.5}Ni_{10}Cu_{17.5}$ alloy during the higher temperature annealing. While still other research has verified that oxygen triggered nucleation of cubic $Zr_2Ni$ phases which act as heterogeneous nucleation sites for crystallization of other stable phases such as tetragonal $Zr_2Cu$ in the $Zr_{65}Al_{7.5}Ni_{10}Cu_{17.5}$ alloy. Combining with others results, it is clear that the crystalline precipitation in the ZrAlNiCu alloy results from oxygen contamination introduced from the raw material and the low vacuum, the oxygen can be regarded as the main cause for the decrease of the GFA of the glass forming system.

Figure 2:
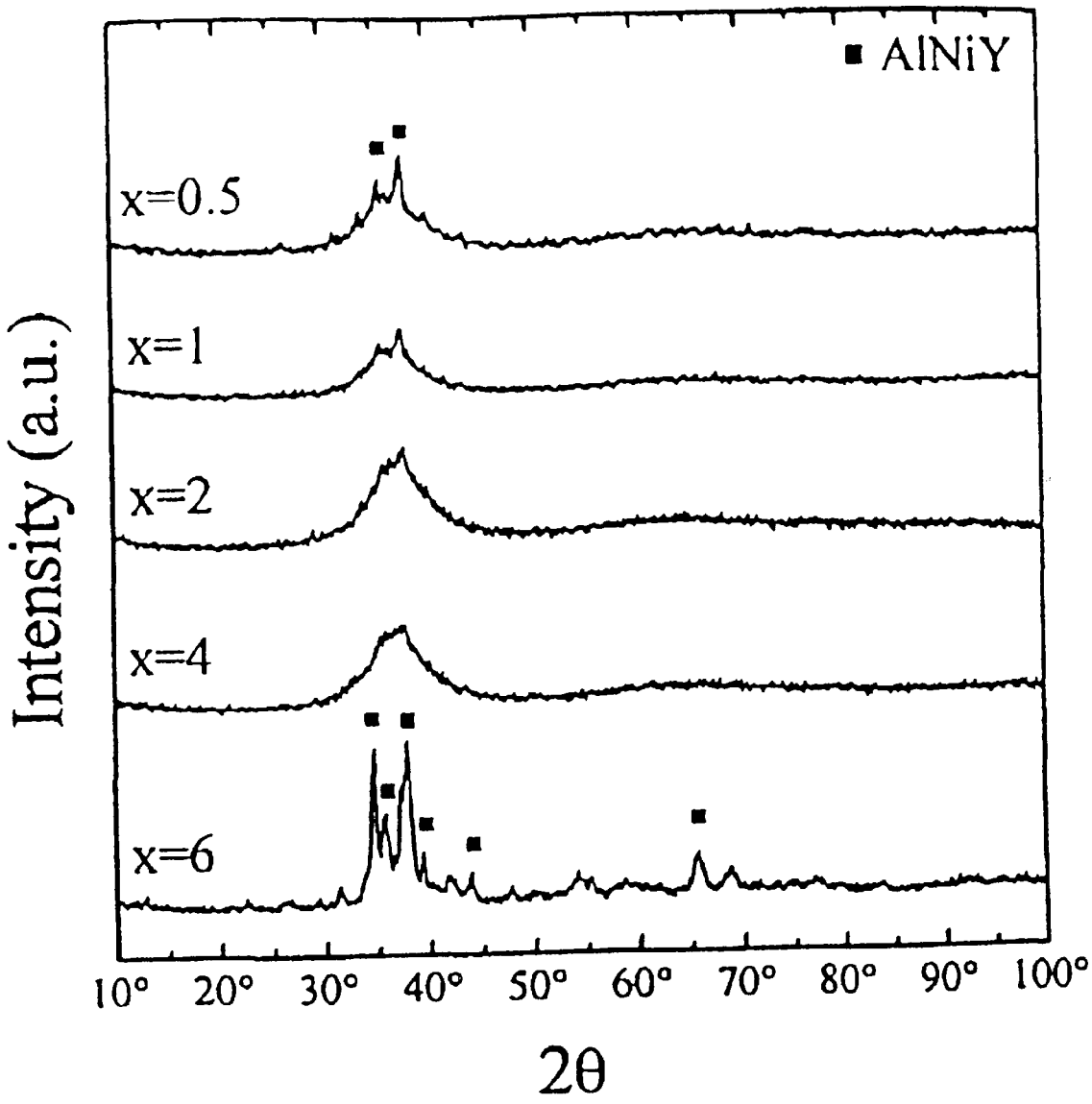
FIG. 2, shows XRD patterns of the $[Zr_{55}Al_{15}Ni_{10}Cu_{20}]_{100-x}Y_x$ alloys.

FIG. 2 displays the XRD patterns of $[Zr_{55}Al_{15}Ni_{10}Cu_{20}]_{100-x}Y_x$ (x=0.5, 1, 2, 4, 6 at %) alloys. The figure shows that 0.5 at % of yttrium addition suppresses the precipitation of cubic $Zr_2Ni$ Laves phase, but some AlNiY crystalline peaks can be observed superimposing on the amorphous diffused scattering peak. With increase yttrium addition from 1 at % to 2 at %, the crystalline peaks become fewer and weaker. When the amount of yttrium reaches 4 at %, almost no crystalline diffraction peaks are observed, and fully metallic glass is formed within the XRD detection limit. With more yttrium addition (>6 at %), crystalline AlNiY phase precipitates. Therefore, a proper yttrium addition can greatly improve the GFA of the $Zr_{55}Al_{15}Ni_{10}Cu_{20}$ alloy, and the yttrium adding can suppress the precipitation of the cubic $Zr_2Ni$ Laves phase. Too little (less than 2 at %) or too much (more than 6 at %) of yttrium addition may lead to the precipitation of yttrium crystalline phase.

Figure 3:
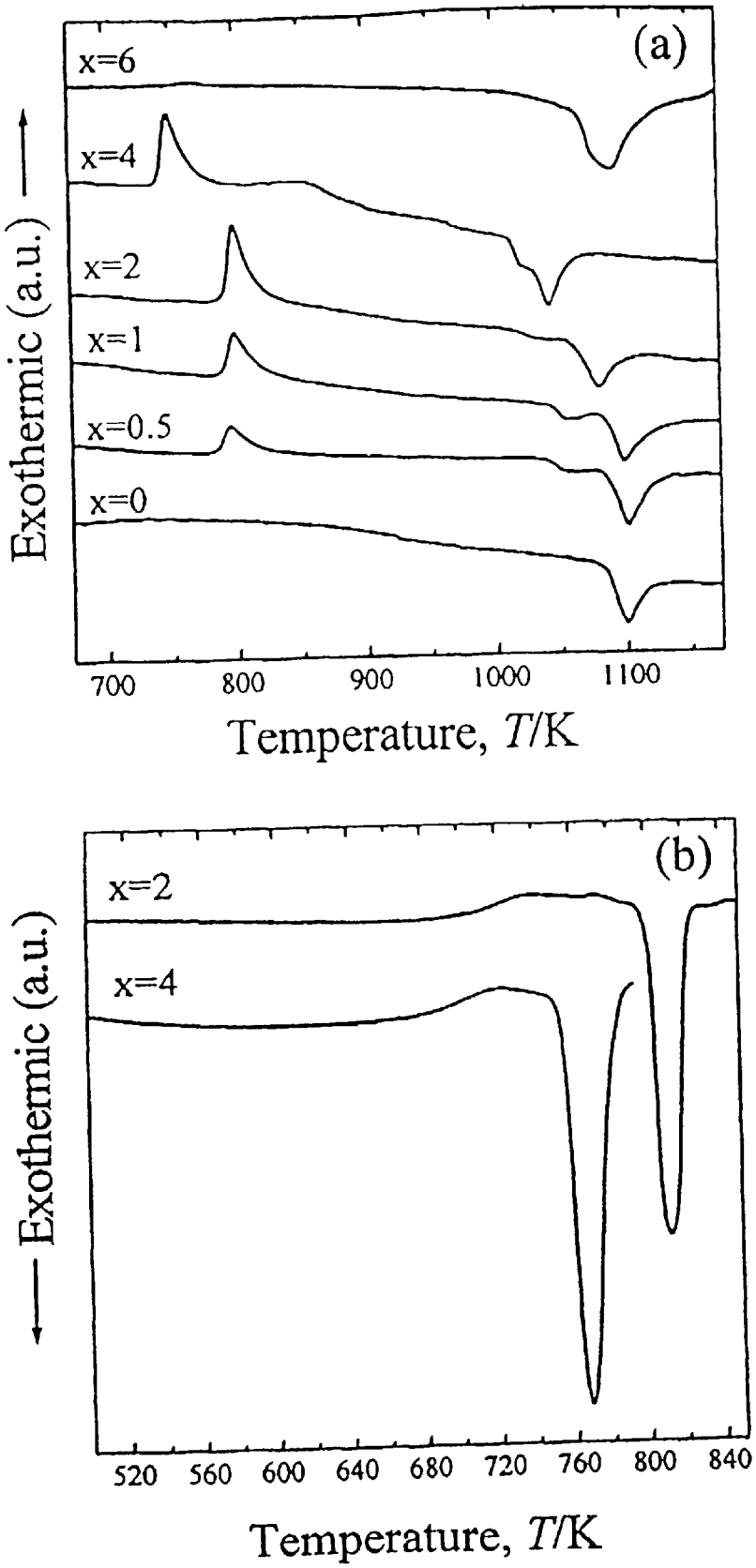
FIG. 3, shows DTA curves of the $[Zr_{55}Al_{15}Ni_{10}Cu_{20}]_{100-x}Y_x$ alloys with a heating rate of 0.33 K/s (a), and DSC cures of $[Zr_{55}Al_{15}Ni_{10}Cu_{20}]_{98}Y_2$ and $[Zr_{55}Al_{15}Ni_{10}Cu_{20}]_{96}Y_4$ alloys with a heating rate of 0.67 K/s.

The effect of yttrium addition on the $Zr_{55}Al_{15}Ni_{10}Cu_{20}$ alloy is also confirmed by DTA and DSC measurements. FIG. 3(*a*) displays the DTA curves of $[Zr_{55}Al_{15}Ni_{10}Cu_{20}]_{100-x}Y_x$ alloys with a heating rate of 0.33 K/s. No exothermic peak is observed for the alloy with x=0, meaning no amorphous phase formed in the $Zr_{55}Al_{15}Ni_{10}Cu_{20}$ alloy without yttrium addition. With 0.5 to 4 at % yttrium addition, an exothermic peak is observed, XRD result indicates the crystallization occurs when the annealing the sample at the reaction temperature. The result confirms the existence of amorphous phase in the alloy. For the alloys with 2 to 4 at % yttrium addition, the DTA traces exhibit distinct exothermic peaks (XRD versifies the crystallization reaction at the temperature), confirming that much more fraction of amorphous phase was formed in the alloys. With 6 at % yttrium addition, there is no exothermic reaction occurring, meaning that there is no amorphous phase formed in the alloy. This result is in a good agreement with the XRD results shown in FIGS. 1 and 2.

FIG. 3(*a*) also shows that the melting temperature, $T_m$ decreases with increasing yttrium addition, more yttrium addition results in higher $T_m$. XRD and DTA results indicate that a small and proper amount of yttrium addition can suppress Laves phase formation and greatly increase the GFA of the $Zr_{55}Al_{15}Ni_{10}Cu_{20}$ alloy. FIG. 3(*b*) is the DSC curves of $[Zr_{55}Al_{15}Ni_{10}Cu_{20}]_{98}Y_2$ and $[Zr_{55}Al_{15}Ni_{10}Cu_{20}]_{96}Y_4$ alloys with a heating rate of 0.67 K/s. Both of them exhibit distinct glass transition process and broaden supercooled liquid region [SLR, defined by the temperature difference between onset crystallization temperature ($T_x$) and glass transition temperature ($T_g$), $\Delta T=T_x-T_g$]. The $T_g$, $T_x$ and $\Delta T$ of $[Zr_{55}Al_{15}Ni_{10}Cu_{20}]_{98}Y_2$ alloy are larger than that of $[Zr_{55}Al_{15}Ni_{10}Cu_{20}]_{98}Y_4$ alloy.

Figure 4:
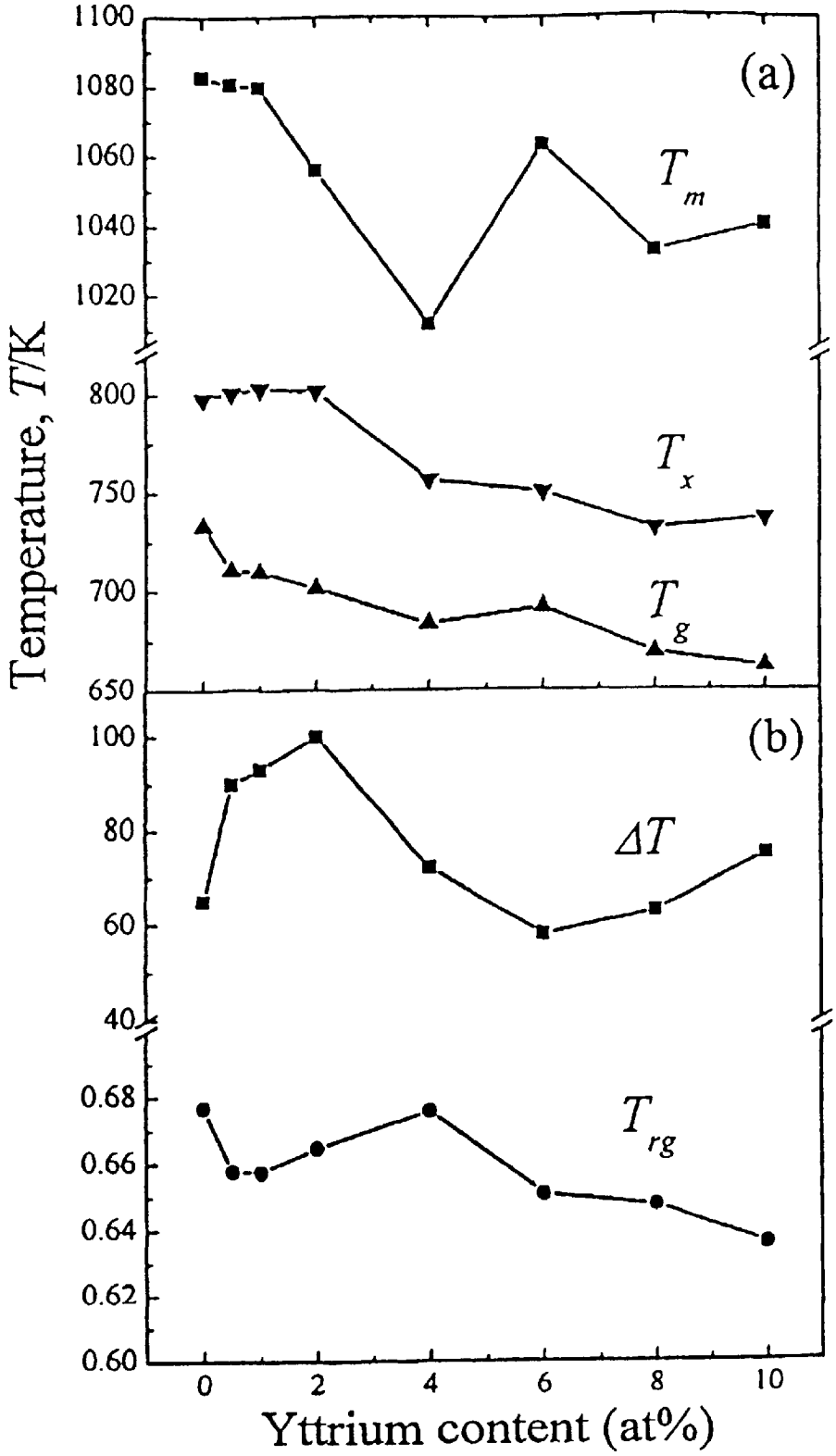
FIG. 4, shows graphs deicting $T_m$, $T_x$ and $T_g$ changes with yttrium addition x for $[Zr_{55}Al_{15}Ni_{10}Cu_{20}]_{100-x}Y_x$ alloys (a), $\Delta T$ and $T_{rg}$ changes with x of $[Zr_{55}Al_{15}Ni_{10}Cu_{20}]_{100-x}Y_x$ alloys (b).

To investigate the effect of yttrium on the thermal properties of the $Zr_{55}Al_{15}Ni_{10}Cu_{20}$ alloys, $[Zr_{55}Al_{15}Ni_{10}Cu_{20}]_{100-x}Y_x$ alloys in a sheet of 0.5 mm thick were prepared by casting the liquid alloys with the same purity and vacuum conditions mentioned above into a wedge-shaped copper mould, fully amorphous phase can be obtained for the alloys with x=0 to 10. The values of $T_g$, $T_x$ and $T_m$ determined by DSC with a heating rate of 0.33 K/s are plotted in FIG. 4(*a*). The figure shows that $T_x$ does not change with the yttrium addition obviously up to x=2, and then decreases slowly with more yttrium addition. The $T_g$ decreases slowly with the yttrium addition. The $T_m$ exhibits a minimum at x=4. The $\Delta T$ and the reduced glass transition temperature $T_{rg}$($T_{rg}=T_g/T_m$) which can represent the GFA of an alloy are plotted in FIG. 4(*b*). For the Y bearing alloys, the $\Delta T$ reaches a maximum at x=2, and $T_{rg}$ reaches a maximum at x=4. It is known that, the larger the $\Delta T$ and $T_{rg}$, the easier the formation of amorphous and the smaller the critical cooling rate. The thermal analysis results further confirm that the GFA of the $Zr_{55}Al_{15}Ni_{10}Cu_{20}$ alloy with low purity components is improved with 2–4 at % yttrium addition.

Figure 5:
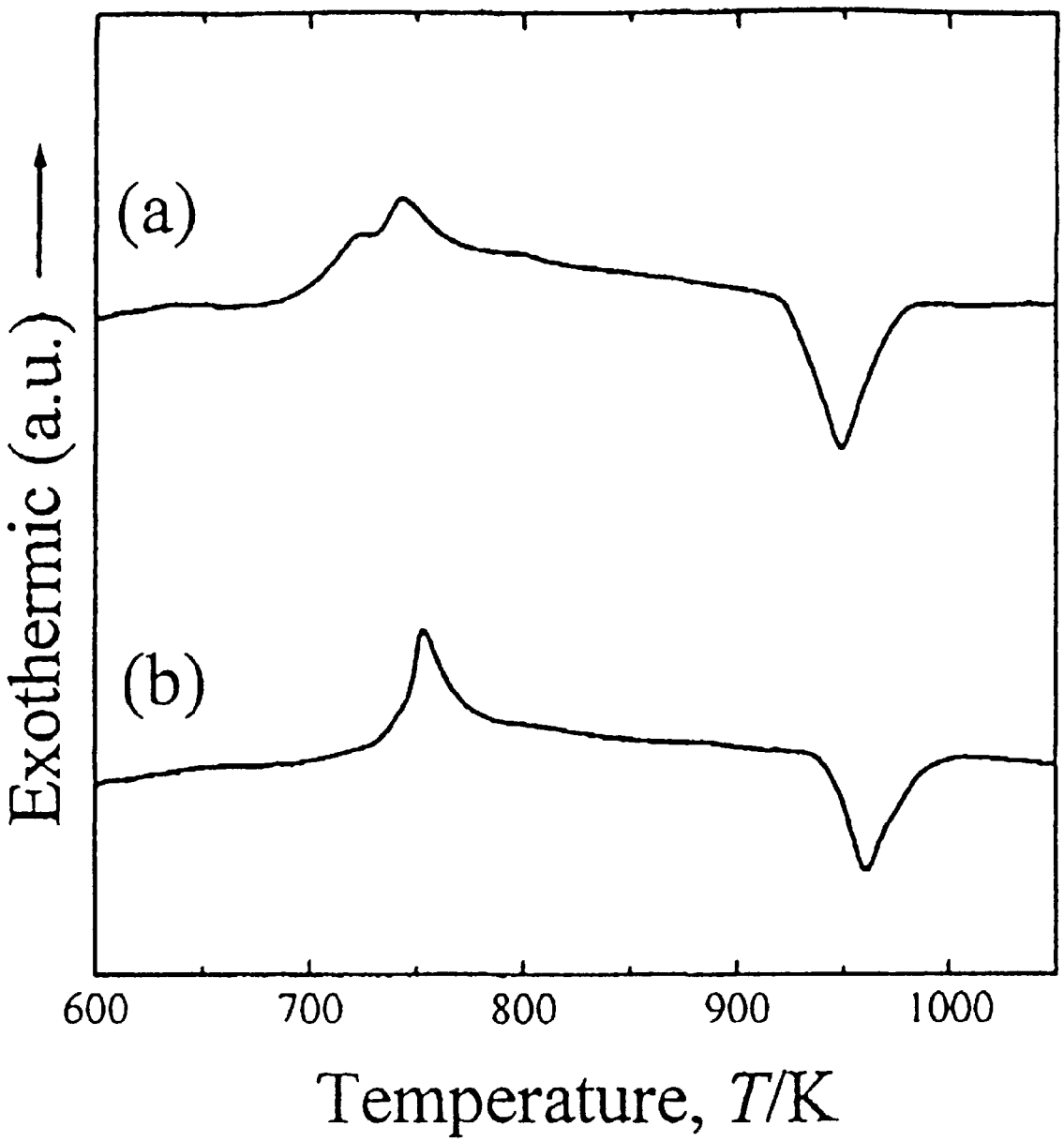
FIG. 5, shows DTA curves of the $Zr_{34}Ti_{15}Cu_{10}Ni_{11}Be_{28}Y_2$ (a), and $[Zr_{41}Ti_{14}Cu_{12.5}Ni_{10}Be_{22.5}]_{98}Y_2$ alloys (b) with a heating rate of 0.33 K/s.

Yttrium has also been introduced in the ZrTiCuNiBe glass forming alloys with low purity of the components, fully amorphous alloys with nomination composition of $[Zr_{41}Ti_{14}Cu_{12.5}Ni_{10}Be_{22.5}]_{98}Y_2$ and $Zr_{34}Ti_{15}Cu_{12}Ni_{11}Be_{28}Y_2$ were obtained. FIG. 5 shows the DTA curves of the alloys with a heating rate of 0.33 K/s. The DTA shows that yttrium addition can also greatly modify the crystallization process of the ZrTiCuNiBe alloy. The crystallization process changes from a multistep crystallization process of ZrTiCuNiBe BMG to a single exothermic peak. The DTA curves also show that the yttrium bearing alloys have a single endothermic peak meaning a single-step melting process. The low temperature (about 960 K) and single melting process facilitates the improvement of GFA. These results indicate that a small amount of yttrium addition can also modify the GFA and the crystallization process of ZrTiCuNiBe alloy.

Elastic properties, such as Young's modulus E, shear modulus G, bulk modulus K, Debye temperature $\theta_D$ and Poison ratio $\mu$ measured by ultrasonic method, and Vicker's hardness Hv, of the Zr-based BMG with yttrium addition are listed in Table 1.

TABLE 1

The Properties Of Y-Modified Zr-Based Bmgs

| Composition | ρ (Kg/m$^3$) | v (GPa) | H (GPa) | Gμ | (GPa) | K (GPa) | Eθ$_D$ (K) |
|---|---|---|---|---|---|---|---|
| $Zr_{41}Ti_{14}Cu_{12.5}Ni_{10}Be_{22.5}$ | $6.13 \times 10^3$ | 5.97 | 37.4 | 0.35 | 114.1 | 101.2 | 328 |
| $[Zr_{41}Ti_{14}Cu_{12.5}Ni_{10}Be_{22.5}$ | $5.86 \times 10^3$ | 6.76 | 40.3 | 0.34 | 109.0 | 107.6 | 337 |
| $Zr_{34}Ti_{15}Cu_{10}Ni_{11}Be_{22.5}]_{98}Y_2$ | $5.78 \times 10^3$ | 6.07 | 41.0 | 0.34 | 113.9 | 109.8 | 352 |
| $Zr_{55}Al_{15}Ni_{10}Cu_{20}$ | $6.51 \times 10^3$ | 5.20 | | | | 90 | |
| $[Zr_{55}Al_{15}Ni_{10}Cu_{20}]_{98}Y_2$ | $6.56 \times 10^3$ | 6.49 | 33.8 | 0.36 | 110.6 | 92.1 | 286 |
| $[Zr_{55}Al_{15}Ni_{10}Cu_{20}]_{96}Y_4$ | $6.44 \times 10^3$ | 5.93 | 31.5 | 0.36 | 104.8 | 86.0 | 275 |

The elastic constants measured by ultrasonic method are very close to the results obtained by other measurements. As shown in Table 1, below, the yttrium addition does not significantly change the Hv and elastic properties of the Zr-based alloys.

While not being bound by theory, the above results indicate that the limiting factor to the glass formation of A Zr-based alloy, such as the $Zr_{55}Al_{15}Ni_{10}Cu_{20}$ alloy, is the precipitation of crystalline $Zr_2Ni$ phase during cooling, for the $Zr_{65}Al_{7.5}Ni_{10}Cu_{17.5}$ alloy, it is the crystalline $Zr_2Cu$. Since the crystalline $Zr_2Ni$ and zirconium oxide are similar in crystalline structure the formation of the crystalline $Zr_2Ni$ can be triggered by zirconium oxide nuclei. According to thermodynamic principle, yttrium has a stronger affinity with oxygen atom compared to that of zirconium, because the yttrium has much higher formation enthalpy (1905.0 kJ/mol) than that of Zirconium (1100.8 KJ/mol). Therefore, the reaction between Y and O is favored compared to the reaction between Zr and O the yttrium addition can substitute zirconium oxide nuclei to yttrium oxide nuclei in the liquid alloy. More yttrium addition leads to the formation of AlNiY crystalline phase such that yttrium oxide greatly hinders the precipitation of $Zr_2Ni$.

Although specific embodiments are disclosed herein, it is expected that persons skilled in the art can and will design alternative Y-doped Zr-based alloys and methods to produce the alloys that are within the scope of the following claims either literally or under the Doctrine of Equivalents.

What is claimed is:

1. An amorphous alloy composed of a plurality of elemental metal components, the amorphous alloy having superior processability and comprising a composition repesented by the general formula:

$$Zr_aM_bN_cY_d$$

wherein:

M is at least one other transition metal element;

N is either Al or Be; and a, b, c, and d are, in atomic percentages of about: $30 \leqq a \leqq 70$, $20 \leqq b \leqq 50$, $5 \leqq c \leqq 20$ and $0.1 \leqq d \leqq 10$.

2. An amorphous alloy as described in claim 1, wherein M is a combination of Ni and Cu, and N is Al.

3. An amorphous alloy as described in claim 1, having a formula of:

$$(Zr_{55}Al_{15}Ni_{10}Cu_{20})_{100-x}Y_x.$$

4. An amorphous alloy as described in claim 1, having a formula of:

$$(Zr_{41}Ti_{14}Cu_{12.5}Ni_{10}Be_{22.5})_{98}Y_2.$$

5. An amorphous alloy as described in claim 1, having a formula of:

$$(Zr_{34}Ti_{15}Cu_{12.5}Ni_{11}Be_{28})_{98}Y_2.$$

6. An amorphous alloy as described in claim 1, wherein the prealloying purity of the Zr elemental metal component of the amorphous alloy is less than 99.8%.

7. An amorphous alloy as described in claim 1, wherein the Zr elemental metal component of the amorphous alloy contains at least 250 ppm of an oxygen impurity prealloying.

8. An amorphous alloy as described in claim 1, having a reduced glass transition temperature of at least 0.6.

9. An amorphous alloy as described in claim 1, having a ΔT of at least 80K.

10. A method of forming an amorphous alloy, comprising:

obtaining elemental metals according to the general formula:

$$Zr_aM_bN_cY_d$$

wherein:

M is at least one other transition metal element,

N is either Al or Be, and a, b, c and d are, in atomic percentages of about: $30 \leqq a \leqq 70$, $20 \leqq b \leqq 50$, $5 \leqq c \leqq 20$ and $0.1 \leqq d \leqq 10$;

melting the elemental metals together under vacuum to form a melted alloy mix; and casting the melted alloy mix into a blank.

11. A method as described in claim 10, wherein M is a combination of Ni and Cu, and N is Al.

12. A method as described in claim 10, having an elemental metal formula of:

$$(Zr_{55}Al_{15}N_{10}Cu_{20})_{100-x}Y_x.$$

13. A method as described in claim 10, having an elemental metal formula of:

$$(Zr_{41}Ti_{14}Cu_{12.5}Ni_{10}Be_{22.5})_{98}Y_2.$$

14. A method as described in claim 10, having an elemental metal formula of:

$$Zr_{34}Ti_{15}Cu_{12}Ni_{11}Be_{28})_{98}Y_2.$$

15. A method as described in claim 10, wherein the Zr has a purity of less than 99.8%.

16. A method as described in claim 10, wherein the Zr contains at least 250 ppm of an oxygen impurity.

17. A method as described in claim 10, wherein the vacuum is a low vacuum.

18. A method as described in claim 10, wherein the blank is an ingot having dimensions of at least 5 mm.

* * * * *